US005709534A

United States Patent [19]

O'Leary

[11] Patent Number: 5,709,534

[45] Date of Patent: Jan. 20, 1998

[54] IV FLUID DELIVERY SYSTEM

[75] Inventor: Stephen H. O'Leary, Encinitas, Calif.

[73] Assignee: IVAC Corporation, San Diego, Calif.

[21] Appl. No.: 613,853

[22] Filed: Mar. 11, 1996

Related U.S. Application Data

[63] Continuation of Ser. No. 287,854, Aug. 8, 1994, Pat. No. 5,513,957.

[51] Int. Cl.[6] ..... F04B 43/12

[52] U.S. Cl. ..... 417/53; 417/474; 604/153

[58] Field of Search ..... 417/53, 474, 478, 417/479; 604/153

[56] References Cited

U.S. PATENT DOCUMENTS

| | | | |
|---|---|---|---|
| 2,105,200 | 1/1938 | Phelps | 128/230 |
| 2,351,828 | 6/1944 | Marsh | 103/148 |
| 2,412,397 | 12/1946 | Harper | 103/148 |
| 3,083,647 | 4/1963 | Muller | 103/148 |
| 3,314,371 | 4/1967 | Hopkinson | 103/148 |
| 3,433,171 | 3/1969 | Lorneil | 417/474 |
| 3,518,033 | 6/1970 | Anderson | 417/478 |
| 3,606,596 | 9/1971 | Edwards | 417/479 |
| 4,039,269 | 8/1977 | Pickering | 417/475 |
| 4,137,940 | 2/1979 | Faisandier | 137/486 |
| 4,199,307 | 4/1980 | Jassawalla | 417/474 |
| 4,236,880 | 12/1980 | Archibald | 417/478 |
| 4,273,121 | 6/1981 | Jassawalla | 128/214 |
| 4,277,226 | 7/1981 | Archibald | 417/38 |
| 4,302,164 | 11/1981 | Manella | 417/474 |
| 4,303,376 | 12/1981 | Slekmann | 417/360 |
| 4,410,322 | 10/1983 | Archibald | 604/153 |
| 4,479,797 | 10/1984 | Kobayashi et al. | 604/153 |
| 4,519,792 | 5/1985 | Dawe | 604/152 |
| 4,559,038 | 12/1985 | Berg et al. | 604/153 |
| 4,561,830 | 12/1985 | Bradley | 417/474 |
| 4,653,987 | 3/1987 | Isuji et al. | 417/474 |
| 4,657,490 | 4/1987 | Abbott | 417/478 |
| 4,893,991 | 1/1990 | Hemingway et al. | 417/53 |
| 4,952,124 | 8/1990 | Ogami | 417/474 |
| 4,967,940 | 11/1990 | Blette et al. | 222/214 |
| 5,055,013 | 10/1991 | Faeser | 417/474 |
| 5,056,992 | 10/1991 | Simons et al. | 417/474 |
| 5,092,749 | 3/1992 | Meijer | 417/479 |
| 5,116,203 | 5/1992 | Waiwick et al. | 417/474 |
| 5,151,019 | 9/1992 | Danby et al. | 417/474 |
| 5,152,680 | 10/1992 | Okada | 417/474 |
| 5,165,873 | 11/1992 | Meijer | 417/474 |
| 5,199,852 | 4/1993 | Danby | 417/26 |
| 5,217,355 | 6/1993 | Hyman et al. | 417/474 |
| 5,302,093 | 4/1994 | Owens et al. | 417/474 |
| 5,320,502 | 6/1994 | Davis | 417/474 |
| 5,320,503 | 6/1994 | Davis | 417/474 |
| 5,322,422 | 6/1994 | Natwick et al. | 417/474 |
| 5,499,906 | 3/1996 | O'Leary | 417/474 |
| 5,511,951 | 4/1996 | O'Leary | 417/474 |
| 5,513,957 | 5/1996 | O'Leary | 417/474 |
| 5,549,460 | 8/1996 | O'Leary | 417/474 |

*Primary Examiner*—Timothy Thorpe
*Assistant Examiner*—Peter G. Korytnyk
*Attorney, Agent, or Firm*—Fulwider Patton Lee & Utecht, LLP

[57] ABSTRACT

An IV pump for delivering fluid through a resilient, deformable tube to improve the accuracy, consistency, and predictability of flow through the tube, wherein a plurality of pinching fingers occlude the tube against a flat portion of a pressure pad, and a plurality of pumping fingers interspaced between said pinching fingers deform the tube (without occluding it) from different directions against a V-shaped portion of the pressure pad to pump the fluid downstream as well as to urge the tube to restore its cross-sectional area.

25 Claims, 7 Drawing Sheets

FIG. 1
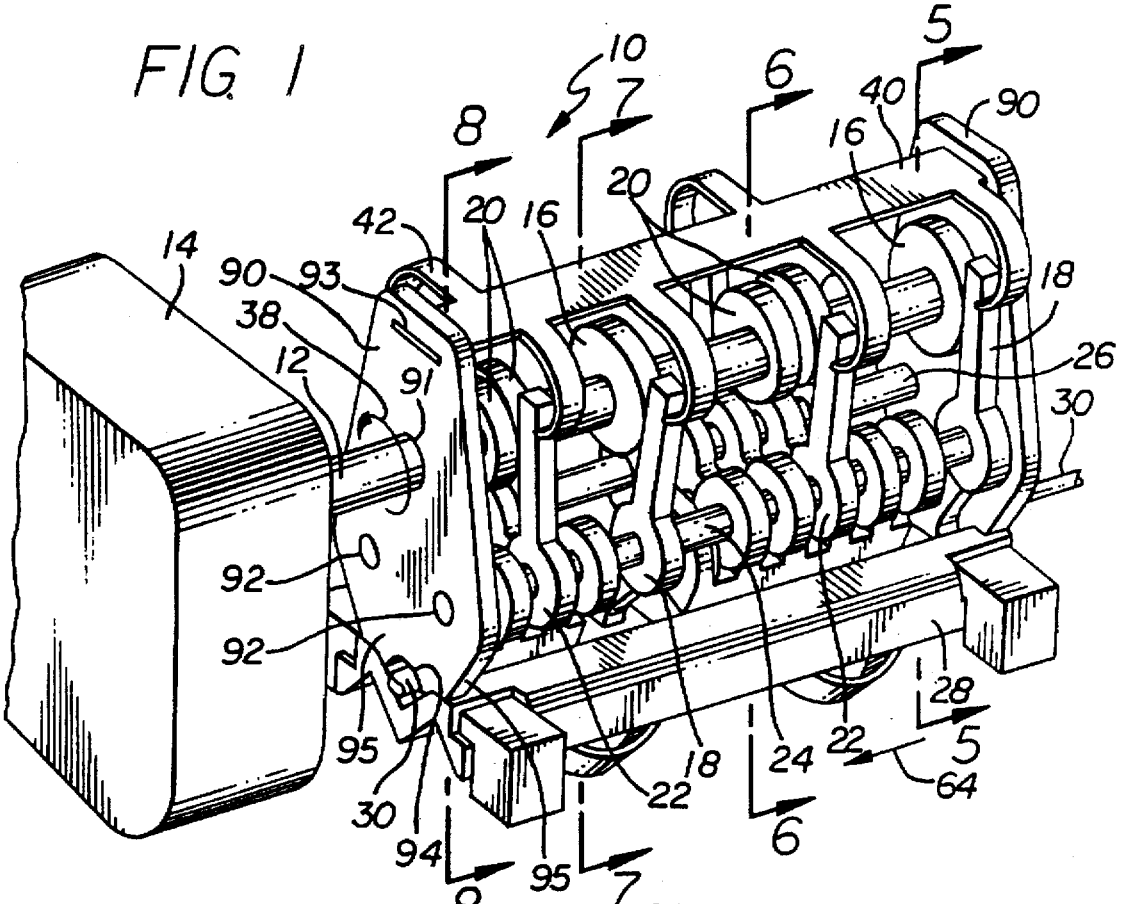
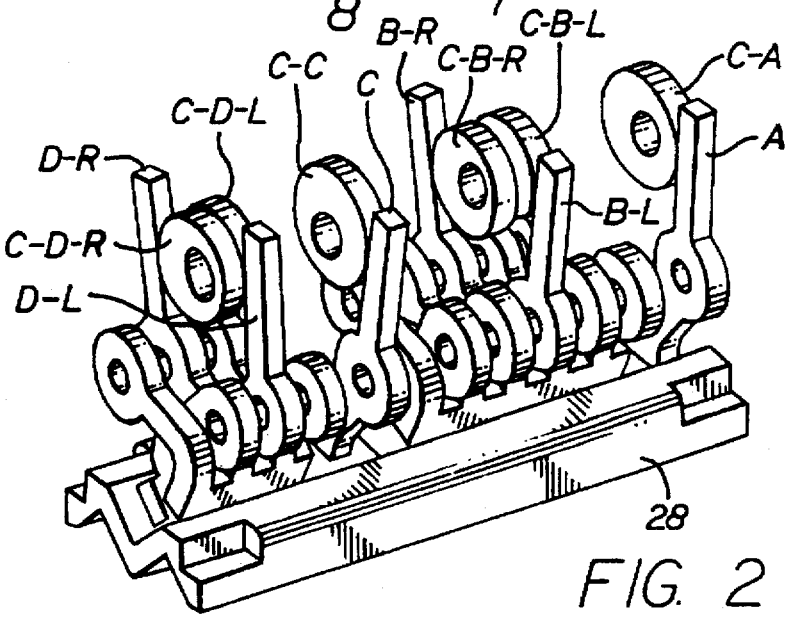
FIG. 2

PUMPING FINGER FULLY RETRACTED (TUBE FULLY OPEN)

PUMPING FINGER AT INTERMEDIATE POSITION (TUBE RESTORED TO ROUND)

PINCHING FINGER FULLY RETRACTED (TUBE COMPRESSED BUT OPEN)

PUMPING FINGER FULLY EXTENDED (TUBE FLATTENED BUT OPEN)

PINCHING FINGER FULLY EXTENDED (TUBE CLOSED)

FINGER POSITION

IV FLUID DELIVERY SYSTEM

This is a continuation of application Ser. No. 08/287,854 filed on Aug. 8, 1994, now U.S. Pat. No. 5,513,957.

BACKGROUND OF THE INVENTION

This invention generally relates to fluid delivery systems that are used to administer medical solutions to patients intravenously. More specifically, the invention relates to intravenous (IV) pumps with a mechanism for improving the predictability, consistency, reliability, and accuracy of fluid flow.

Physicians and other medical personnel apply IV infusion therapy to treat various medical complications in patients. For safety reasons and in order to achieve optimal results, it is desirable to administer the IV fluid in accurate amounts as prescribed by the physician and in a controlled fashion. Certain IV delivery systems use a simple arrangement, whereby the IV fluid flows from an elevated reservoir via a length of flexible tubing connected by a catheter or the like to the patient's vascular system. In these systems, a manually adjustable clamp is used to apply pressure on the tubing to control the cross-sectional area of the tube opening to thereby control the flow rate. However, due to factors such as temperature changes which can affect the shape of the tubing, and the unpredictability of the interaction between the tubing and the clamp, such systems have not proven to be very accurate in controlling and maintaining a prescribed fluid flow rate over an extended period of time. Moreover, delivery pressure is limited in a practical sense by the head height of the fluid source and, in many instances, a greater delivery pressure is required to accomplish the desired IV infusion to the patient.

Over the years, various devices and methods have been developed to improve the administration of IV fluids under positive pressure in a controlled and accurate fashion. One such example can be found in peristaltic pumps which act on a portion of the tubing carryin the IV fluid between a fluid reservoir and the patient to deliver fluid under pressure and to control the flow rate. More specifically, a peristaltic pump is a mechanical device that pumps the fluid in a wave-like pattern by sequential deformation and occlusion of several points along the length of the resilient, deformable tubing which carries the IV fluid. Operation of such a pump typically involves a mechanical interaction between a portion of the resilient, deformable tubing, a peristaltic mechanism (i.e., a mechanism capable of creating a wave-like deformation along the tube), a pressure pad for supporting the tube, and a drive mechanism for operating the peristaltic mechanism.

In such a system, the tubing is placed between the peristaltic mechanism and the pressure pad so that the peristaltic mechanism can sequentially deform and create a moving zone of occlusion along the portion of the tube. The speed of the drive mechanism may be adjusted to control the pumping cycle and to achieve the desired flow rate. As known by those skilled in the art, peristaltic pumps have provided a major improvement over older methods in achieving consistency and accuracy in the flow rate of the IV fluid.

Another example of improved fluid delivery systems can be found in pumps with multiple fingers, whereby some fingers pinch and occlude the tube and some fingers deform the tube without occluding it. For example, some multi-finger pumps employ three or four fingers, wherein the fingers that occlude the tube and the fingers that do not occlude the tube are typically located in alternating fashion along the length of the pump. At any given time, one of the fingers is occluding the tube, while other fingers alternatingly go through their pumping (closing) and filling (retracting) strokes. The movement of the fingers is synchronized so as to force the fluid to flow inside the tube from the upstream end of the pump to the downstream end of the pump, and eventually to the patient.

It has been found desirable to increase the uniformity of the fluid flow rate and one factor that directly affects fluid flow in a fluid delivery pump is the cross-sectional area of the tube lumen or opening. Generally, IV sets that are used with fluid delivery pumps have resilient, deformable tubes (typically made of PVC) with a circular cross sections, although other shapes may also be used. In order to provide further control over the flow rate, it is desirable to maintain the original cross-sectional area of the tube.

In many of the above mechanisms, after a portion of the tube is deformed under the force of the fingers and the fingers are no longer applying force against the tube, the mechanism relies on the fluid that is under pressure to assist the deformed tube to open up as well as on the elastic nature of the tube to restore its shape to the undeformed state. However, as the portion of the tube that interacts with the pump is repeatedly deformed between the pressure pad and the fingers, the resiliency of the tube can be compromised and instead of the tube restoring itself to its original shape after each deformation, a non-elastic deformation of the tube may occur. While there are tubes that exhibit various degrees of resiliency, even the IV sets with highly resilient tubes, which typically are more expensive and may have to be custom made, may experience a short-term or long-term deformation as a result of counter forces exerted on the tube by the fingers and the pressure pad. Such a deformation may occur despite efforts to design and manufacture the components of the pump with appropriate tolerances for relieving excessive forces that may be generated between various components of the pump. An effect of such deformation of the tube is that it generally alters the cross-sectional area of the tube lumen and may reduce the amount of fluid flow to the patient per each occlusion of the tube by the fingers. As can be appreciated by those skilled in the art, such an occurrence is undesirable.

Also, in many of the previously designed pump mechanisms, the deformation of the tube between the fingers and the pressure pad occurs from the same directions throughout the operation of the pump. Such a design increases the possibility of creating a permanent deformation in the tube.

Thus, there is a need for an IV pump with a mechanism that substantially restores the shape of the tube to reduce the possibility of permanent deformation and change in the cross-sectional area of the inner lumen of the tube. Such an IV pump would enhance the accuracy, reliability, consistency, and predictability of fluid flow. The present invention fulfills these needs.

SUMMARY OF THE INVENTION

Briefly, and in general terms, the present invention is directed to a fluid delivery pump with a mechanism that uses some fingers to alternatingly occlude a portion of a resilient, deformable tube, while other fingers deform the tube to pump IV fluid to the patient. In this mechanism, the fingers that pump the IV fluid are also designed to urge the tube to restore its cross-sectional area during the operation of the pump. By urging the restoration of the shape of the tube, the mechanism of the present invention serves to provide a consistent lumen size in the tube, so that the volume of fluid displaced by each pumping cycle remains substantially constant over time.

More specifically, a fluid delivery pump in accordance with the present invention comprises two groups of fingers associated and engaged with individual drive cams. The first group comprises two pinching fingers that are engaged with two associated cams, and are designed to alternatingly fully occlude a resilient, deformable tube against a flat portion of a pressure pad and then release the tube which carries IV fluid to the patient. The alternate opening and closing of the pinching fingers means that, at any given time, one pinching finger always occludes the tube so that there is no direct flow path from the fluid supply to the patient, and ensures that uncontrolled flow of fluid through the pump does not occur.

The second group of fingers comprises two sets of pumping fingers, wherein each set includes two opposing fingers in contact with individually associated drive cams. The two sets of pumping fingers are alternatingly arranged with the two pinching fingers along the length of the pump. The opposing pumping fingers in each set alternatingly apply force sufficient to deform the tube against a substantially V-shaped portion of the pressure pad without occluding it. At the end of the closing motion of a pumping finger, the tube is flattened against one side wall of the V-shaped pad without being completely occluded. After that pumping finger fully advances and completes its downward closing cycle, it begins to retract from the deformed and flattened tube, and as it approaches full retraction, the opposite facing pumping finger begins its closing cycle and applies force on the edge of the same flattened portion of the tube so as to cause the tube to open up.

After opening the tube, the same pumping finger continues its closing cycle and advances until the tube is flattened again against the other side wall of the V-shaped portion of the pressure pad. In addition to performing a pumping function, by alternately forcing the tube back through its relaxed shape on the way to flattening it, the opposing pumping fingers also restore the cross-sectional area of the tube. However, in order to achieve a substantially uniform flow through the tube, it is not required that the tube be restored to a full round cross section.

In one aspect of the invention, the pinching fingers and the pumping fingers move in a rocking motion transverse to the longitudinal axis of the tube. The rocking motion of the fingers is accomplished by spring loading the upper portion of each finger against a cam to maintain contact with the cam, while mounting the middle portion of each finger on a stationary pivot shaft which is parallel to the cam shaft and the tube. This allows each finger to pivot such that its lower portion may move in a transverse direction with respect to the tube.

In another aspect of the invention, the surface of each pumping finger which comes in contact with the tube is longer than the contact surface of the pinching fingers. As to the pumping finger sets, the contact surfaces of the opposing pumping fingers in the set that is further upstream are longer than the contact surfaces of the pumping fingers located downstream. By forcing the opposing pumping fingers and the pinching fingers to advance and retract according to a pre-arranged schedule and pattern, the pump of the invention directs the fluid to travel from the upstream end of the pump to the downstream end of the pump in a substantially constant volume of flow. Also, by adjusting the speed of the motor, different flow rates can be achieved.

As briefly stated above, in yet another aspect of the invention, the pressure pad used in the pump of the invention includes both V-shaped portions and flat portions. The geometry of the V-shaped portions is designed to accommodate the movement of the opposing pumping fingers which deform and flatten the tube against the two side walls. The flat portions of the pressure pad are raised so as to accommodate the occlusion of the tube under the force of the pinching fingers. The spring loading of the upper portion of the pinching fingers against the associated cams provides the occlusion force by the pinching fingers on the tube. In order to accommodate the use of IV tubing with normal variations in wall thickness and material stiffness, the spring loaded pinching fingers are designed to move far enough to occlude thin-walled tubes. For thick-walled tubes, each pinching finger is designed to lose contact with its associated cam so as not to generate excessive forces on thick-walled tubes. Also, in order to relieve excessive forces that may be applied on the tube between the fingers and the pad or applied between the pressure pad and a pair of spacers (spacers described in the following paragraph), the entire pressure pad is preferably spring-loaded toward the fingers into a fixed position relative to the shafts.

According to yet another aspect of the invention, a mechanism is provided to properly locate the pressure pad with respect to the fingers and to minimize the accumulation of design tolerances in the area where the tube is being manipulated. To accomplish these objectives, two stationary spacers, one at each end of the pump, are mounted on the stationary pivot shafts. Each spacer engages the upper surface of the pressure pad to ensure the proper location and spacing of the pressure pad with respect to the fingers. The lower portion of each spacer includes a cut-out portion to allow the tube to run through the spacer. These spacers also carry the cam shaft and the biasing spring that acts on the upper portion of the fingers.

Also, the pump of the invention includes a mechanism actuated by the opening of the pump door which causes the pumping fingers that are at or near their advanced positions to retract so as to allow the tube to be loaded in the pump between the V-shaped portions of the pressure pad and the pumping fingers. Although the pinching fingers could also be designed to retract in such a mechanism, such a design is not necessary. This is due to the fact that the closing of the door moves the flat portions of the pressure pad in a relatively perpendicular direction with respect to the flat contact surfaces of the pinching fingers.

These and other advantages of the invention will become more apparent from the following detailed description thereof, taken in conjunction with the accompanying exemplary drawings.

BRIEF DESCRIPTION OF THE DRAWINGS

FIG. 1 is a perspective view of a pump mechanism embodying the present invention.

FIG. 2 is a similar perspective view of the pump mechanism shown in FIG. 1, with certain components of the mechanism, namely, the motor, the cam shaft, and the two pivot shafts removed for better viewing of the remaining components.

DETAILED DESCRIPTION OF THE PREFERRED EMBODIMENT

Figure 3:
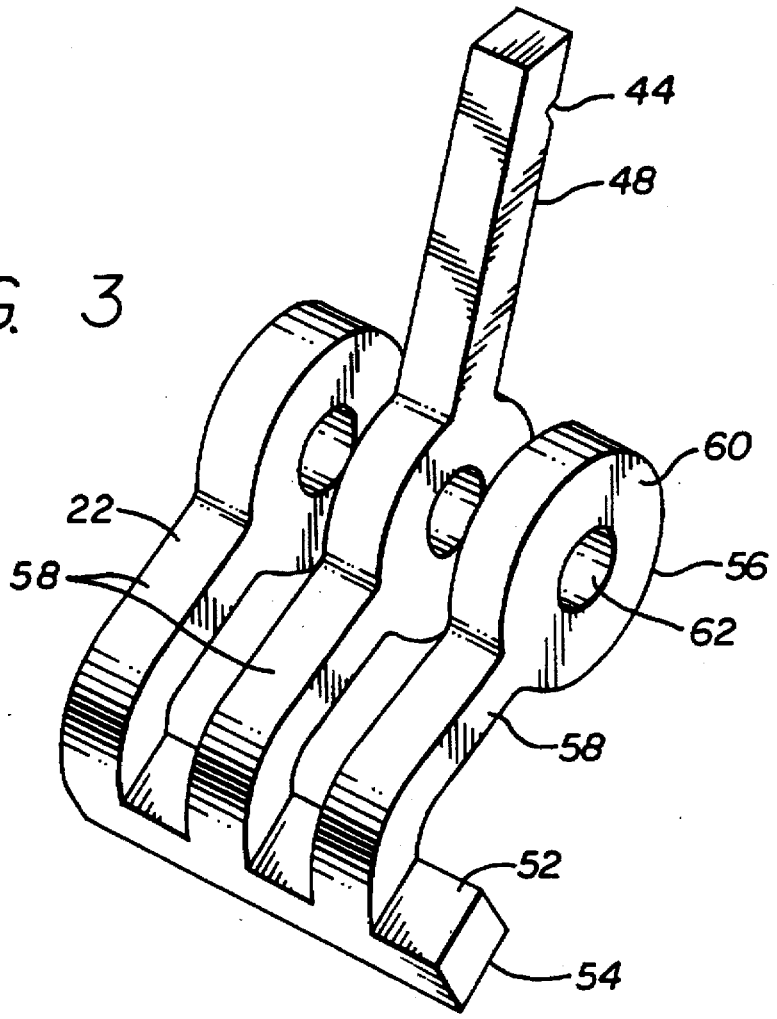
FIG. 3 is a perspective view of a certain component of the pump mechanism shown in FIG. 1, namely, one of the pumping fingers.

The present invention is embodied in a pump mechanism 10 as generally illustrated in FIG. 1. Pump 10 generally includes a plurality of pinching fingers 18 that alternatingly occlude (against a pressure pad 28) and release a portion of a resilient, deformable tube 30 that carries IV fluid from an elevated reservoir to a patient (fluid reservoir and the patient not shown), a plurality of opposing pumping fingers 22 that alternatingly apply force to deform the tube 30 in order to pump the IV fluid downstream to the patient. In addition to pumping the fluid, the opposing pumping fingers 22 serve to urge the tube 30 to restore its cross-sectional area. A motor 14 provides the driving force for the movement of the pinching fingers 18 and the pumping fingers 22 by being engaged with a cam shaft 12. The cam shaft 12 has a plurality of pinching cams 16 and a plurality of pumping cams 20, which are respectively associated with the pinching fingers 18 and the pumping fingers 22. Pinching fingers 18 are identical to each other in shape and are alternatingly positioned adjacent opposing pumping fingers 22 which are grouped in two sets; one upstream and one downstream (see arrow 64 in FIG. 1, pointing to the downstream direction of fluid flow). Also, the pumping fingers 22 are identical to each other in shape, except that the pumping fingers located upstream are longer than the pumping fingers located downstream.

As the motor 14 rotates the cam shaft 12 and the cams that are positioned on the cam shaft 12, the pinching fingers 18 and the pumping fingers 22 move in a rocking motion according to a predetermined pattern and order which results from the particular shape and orientation (phase angle) of each cam positioned on the cam shaft. When in the fully advanced position, each pinching finger 18 occludes a portion of the tube 30 located under the finger against a raised flat portion 32 the pressure pad 28. After a period of occlusion, each pinching finger 18 retracts to a position that leaves the tube in an open condition.

As to the pumping finger sets 22 which are located in alternating fashion adjacent the pinching fingers, each pumping finger 22 in a set moves in a rocking motion in different direction as the other, and alternatingly applies force on the same portion of the tube 30 against a V-shaped portion 36 of the pressure pad 28 that is designed with right and left side walls 74 and 76. After each pumping finger in a set advances and deforms (without occluding) the tube 30, it fully retracts and the opposite pumping finger advances and deforms the tube without occluding it.

More specifically, as each pumping finger 22 begins to advance, it first contacts the deformed (but not occluded) tube 30 which has previously been flattened by the other pumping finger in the pair against the pressure pad and then urges it to restore its original circular shape. Thereafter, the same pumping finger continues its rocking motion to deform and flatten the tube against the pressure pad 28. As stated, the movement of the pumping fingers serves both to pump the IV fluid downstream toward the patient as well as to provide a restoring force on the portion of the tube under the pumping fingers. Furthermore, when the portion of the tube under each pumping finger set is forced to restore its shape, the adjacent portion of the tube located under the pinching finger that is retracted is also urged to restore its shape, although to a lesser extent.

The motion of the pinching and pumping fingers 18 and 22 occurs according to a predetermined pattern which is designed to provide a substantially uniform flow during the rotation of the motor 14. Accordingly, the pinching cams 16 and the pumping cams 20 which are respectively associated with the pinching and pumping fingers 18 and 22 are specifically contoured and oriented along cam shaft with appropriate phase angles.

In more detail, with reference to FIG. 1, the cam shaft 12 is engaged with the motor 14 which rotates in a direction as shown by arrow 38. The motor 14 is preferably a stepper motor, however, other means that may result in the rotation of the cam shaft 12 may be used. The pump mechanism 10 preferably utilizes two pinching fingers 18 associated with two pinching cams 16, and two pumping finger sets 22, with each pumping finger associated with a pumping cam 20. FIG. 2 shows the same pump mechanism as in FIG. 1, except that the motor 14 and two pivot shafts 24 and 26 (described below) have been removed for better viewing of details, and FIG. 3 shows one of the downstream pumping fingers in isolation. The two pumping finger sets 22 are alternatingly located adjacent the two pinching fingers 18. Alternatively, a different number of fingers or cams may be used to accomplish a similar result. It should be noted that in all of the figures, for purposes of simplicity, the cams 16 and 20 are shown as eccentric circles, whereas the actual cam shapes that would be required to achieve the desired motions of the fingers will differ.

Figure 4:
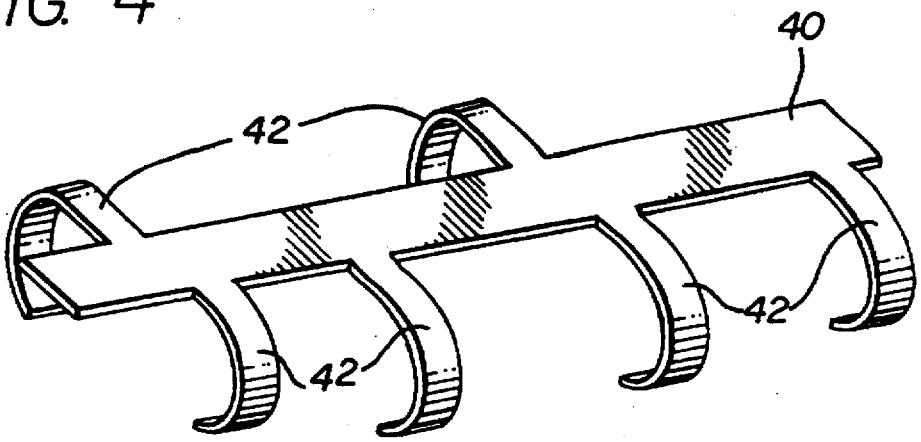
FIG. 4 is a perspective view of another component of the pump mechanism shown in FIG. 1, namely, the finger biasing spring.

Each of the pinching and pumping fingers 18 and 22 is biased by a finger biasing spring 40 to maintain contact with its associated cam. A preferred embodiment of the finger biasing spring 40 with the appropriate number of arms 42 for contact with the pinching and pumping fingers 18 and 22 can be seen in FIGS. 1 and 4. As shown in cross-sectional views of FIGS. 5–8 which will be described in detail below, each arm 42 of the finger biasing spring 40 is seated in a notch 44 formed on the outside of an upper portion 46 of the pinching fingers 18 and an upper portion 48 of the pumping fingers 22. The individually flexible nature of each arm 42 of the finger biasing spring 40 allows each arm to be deflected as necessary by the finger that it is in contact with. Instead of the self-aligning method described, other methods may be used to engage the finger biasing spring 40 with the fingers. Also, other means such as simple extension springs acting on the upper portions of the fingers or torsion springs may be employed to cause the fingers to maintain contact with their associated cams.

The widths of the pinching cams 16, the pumping cams 20, lower portion 50 and upper portion 46 of the pinching fingers 18, and upper portion 48 of the pumping fingers 22 are all equal. However, in the pumping fingers 22, the width of lower portion 52 that contacts and deforms the tube is greater than the width of the lower portion 50 of the pinching fingers 18. In addition, since the upstream pumping fingers must pump more fluid than the downstream pumping fingers (to fill an extra volume of tube under the downstream pumping fingers), the width of the lower portion 52 of the upstream pumping finger is greater than the width of the lower portion 52 of the downstream pumping finger.

For ease of identification, as shown in FIG. 2, starting from the upstream end of the pump, each finger and each cam is identified by the letters A through D. Therefore, starting from the upstream end of the pump, pinching finger A is in contact with pinching cam C-A, the two opposite facing pumping fingers B-L and B-R are respectively in contact with two pumping cams C-B-L and C-B-R, pinching finger C is in contact with pinching cam C-C, and the two opposite facing pumping fingers D-L and D-R are respectively in contact with pumping cams C-D-L and C-D-R. The "L" and "R" designations are used to identify the specific pumping fingers according to the direction (Left or Right) from which they contact the tube.

More specifically, viewing from the downstream end of the pump (i.e., looking upstream against the direction of flow), each pumping finger 22 having lower portion 52 (see FIG. 6) that contacts the tube 30 from the right side is referred to as a right hand pumping finger (i.e., B-R and D-R pumping fingers). Similarly, each pumping finger 22 having lower portion 52 that contacts the tube 30 from the left side is referred to as a left hand pumping finger (i.e., B-L and D-L pumping fingers). Also, each of the cams associated with a pumping finger is referred to according to the identification of that pumping finger (i.e., C-A and C-C cams associated with the pinching fingers and C-B-R, C-B-L, C-D-R, and C-D-L cams associated with the pumping fingers).

Referring to FIG. 3 which shows one of the downstream pumping fingers in isolation, the lower portion 52 of each pumping finger 22 is made of a continuous strip of material with a flat contact surface 54 for applying force on the tube, while a middle portion 56 of each pumping finger is split in three legs 58 with the upper portion 48 of the pumping finger extending from the middle leg. This slotted design allows the opposite facing fingers in each set of pumping fingers to be able to pass through one another during their alternate rocking motion. The upstream pumping fingers are similar to FIG. 3, except that the middle portion 56 is divided into five legs 58 (see FIG. 2). The middle portion 56 of each pumping finger 22 has a round segment 60 with an aperture 62 appropriately sized for being pivotally mounted on one pivot shafts 24 and 26. Specifically, the aperture 62 of each left hand pumping finger is mounted on the left pivot shaft 24 and the aperture 62 of each right hand pumping finger is mounted on the right pivot shaft 26.

Figure 5:
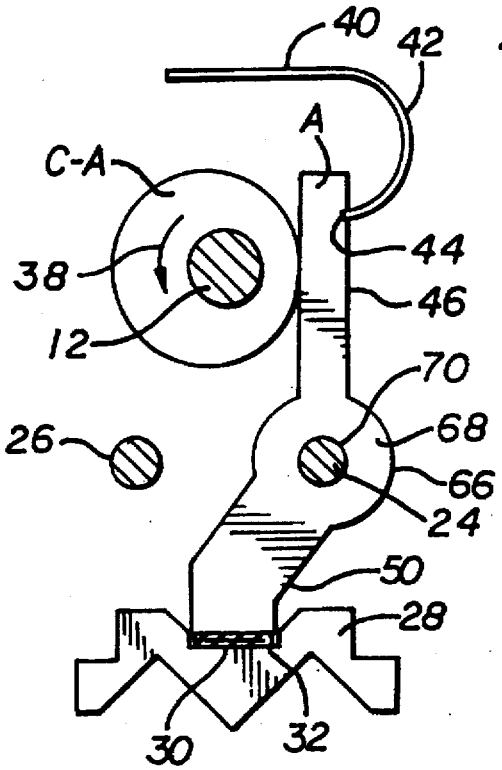
FIG. 5 is a cross-sectional view, taken at line 5—5, of the pump mechanism shown in FIG. 1, showing the upstream pinching finger A at the start of a pump cycle.
Figure 7:
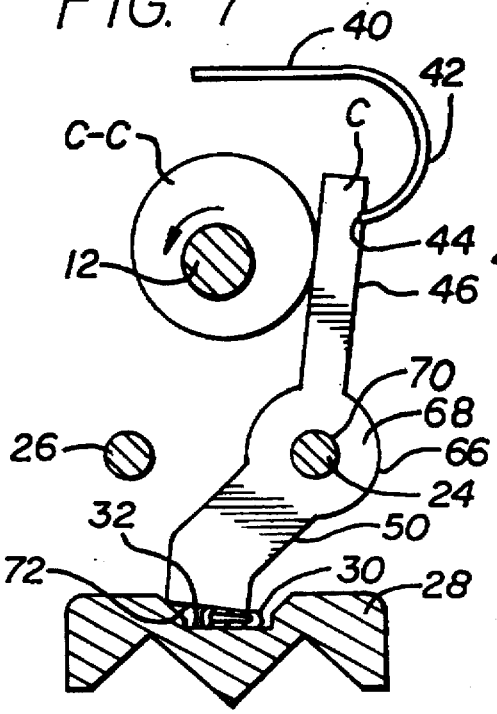
FIG. 7 is a cross-sectional view, taken at line 7—7, of the pump mechanism shown in FIG. 1, showing the downstream pinching finger C at the start of a pump cycle.

Similar to the pumping fingers, as shown in FIGS. 5 and 7, each pinching finger 18 has a middle portion 66 having a round segment 68 therein whose round aperture 70 is fitted around the left pivot shaft 24 (see FIGS. 5 and 7). Also, the lower portion 50 of each pinching finger 18 has a straight contact surface 72 which comes in contact with the tube. Alternatively, other shapes may be utilized for the contact surface 72 of the pinching fingers 18.

A portion of the tube 30 which carries the IV fluid to the patient is placed between the pressure pad 28 and the fingers such that the tube 30 lies a fixed distance from and substantially parallel to the longitudinal axis of the cam shaft 12. The contact surface 72 of the lower portion 50 of each pinching finger 18 alternatingly occludes and releases a portion of the tube 30. Also, the contact surface 54 of the lower portion 52 of each pumping finger 22 alternatingly flattens (without occluding) and releases an adjacent portion of the tube 30.

Figure 9:
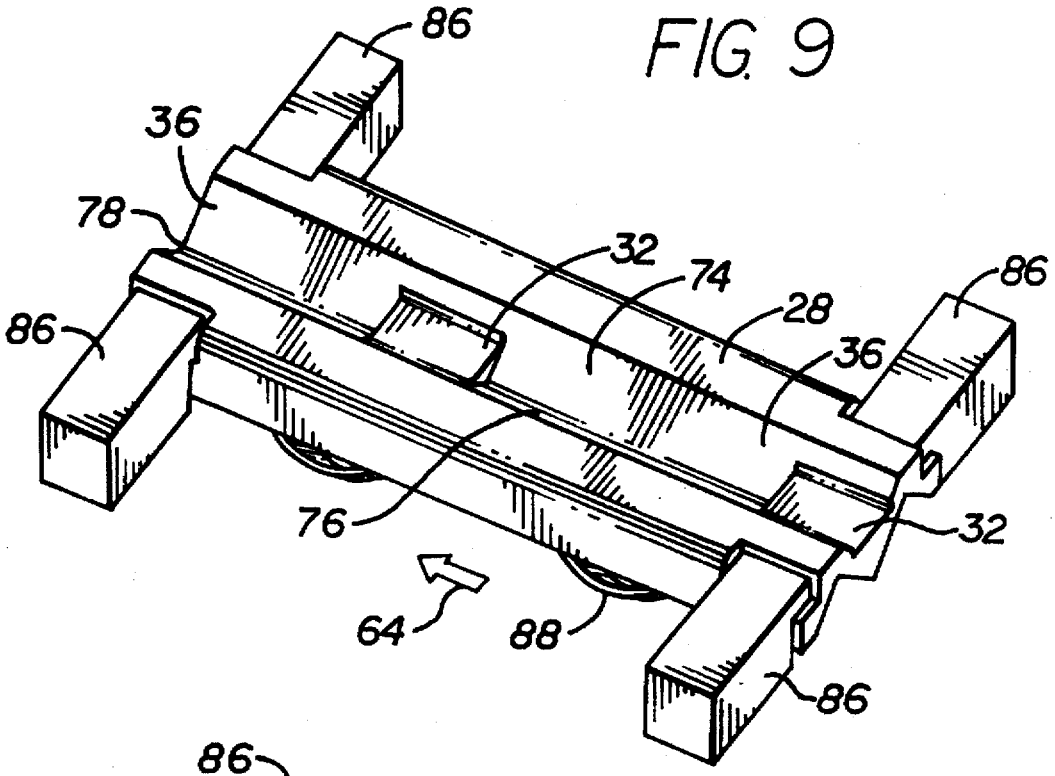
FIG. 9 is a top perspective view of another component of the pump mechanism shown in FIG. 1, namely, the pressure pad.

Furthermore, as can be seen in FIG. 9 and as stated above, the pressure pad used in the pump of the invention includes two raised flat portions 32 which are located under the two pinching fingers and two V-shaped portions 36 located under the two sets of pumping fingers. Also, the V-shaped portions 36 of the pressure pad 28 have right and left side walls 74 and 76, respectively, and a pointed tip 78 located directly under the cam shaft 12.

Figure 10:
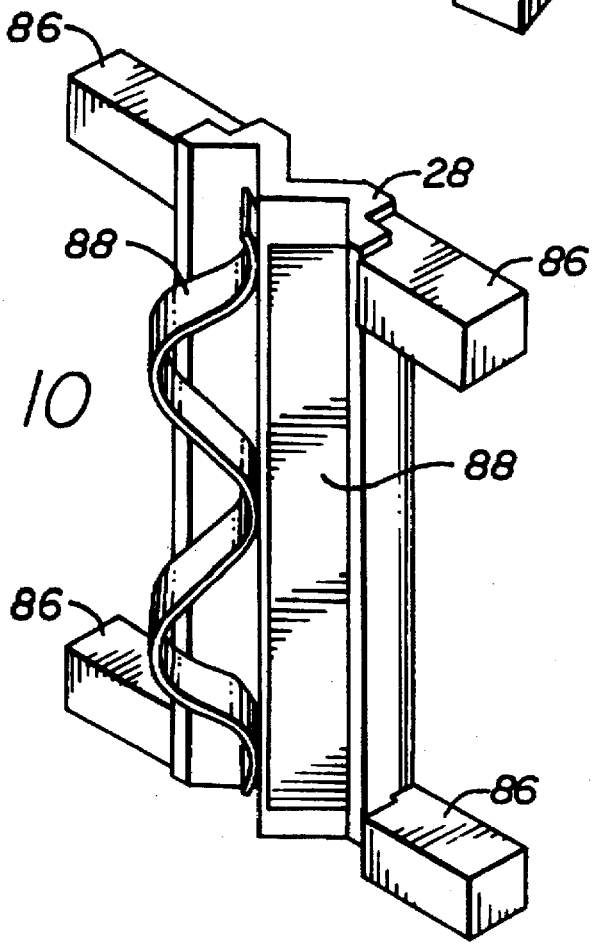
FIG. 10 is a perspective view of the pressure pad shown in FIG. 9, showing the underside thereof.

The pressure pad 28 is incorporated within a door 84 of the pump via door-mounted retainers 86 that hold both ends of the pressure pad secured to the door (see FIGS. 9, 10, 12, and 13). The door 84 which is preferably hinged and latched to the pump frame 85 (latching mechanism not shown) is opened for placing the tube between the pad and the fingers. The Pressure pad 28 is biased against the tube 30 by pressure pad springs 88 located between the door 84 and the underside of the pressure pad. The pressure pad springs 88 shown in FIG. 10 are preferably two leaf springs located along the length of the pressure pad, however, other biasing means such as coil springs (not shown) located at each end of the pressure pad may alternatively be used.

As shown in FIG. 1, preferably a pair of spacers 90, one at each end of the pump, is provided to minimize the accumulation of design tolerances in the area where the tube is being manipulated by ensuring the proper location and spacing of pressure pad with respect to pinching and pumping fingers. Each spacer 90 has one aperture 91 mounted on the cam shaft 12 and two apertures 92 mounted on the left and right pivot shafts 24 and 26. The upper portion of each spacer bracket has a slot 93 which secures and receives the two ends of the finger biasing spring 40 therein. The lower portion of each spacer bracket 90 has a notch 94 appropriately sized to allow for the passage of the tube 30 and the proper positioning of the tube into the mechanism during loading. Also, the lower portion of each spacer 90 has a pair of legs 95 which are shaped to mate against the upper portion of the pressure pad 30. The pressure pad 28 is biased by the pressure pad springs 88 against the spacers 90 (through mating with the legs 95 of the spacer 90) with enough force to ensure that it will not be dislodged by the force of the tube being occluded.

In order to better illustrate the complete cycle of the pump mechanism, FIGS. 5–8 show a series of cross-sectional views taken at points along the length of the pump 10 to show the interaction between the pinching and pumping fingers with the tube at the beginning of the operational cycle of the pump.

FIG. 5 shows pinching finger A at the beginning of the mechanism cycle. At this point in time, pinching finger A has fully advanced to occlude the tube 30 against a flat portion 32 of the pressure pad 28 so as to prevent fluid flow across this portion of the tube. It should be noted that although the pinching fingers move in a rocking motion, the straight contact surface 72 of the lower portion 50 of the pinching fingers becomes substantially parallel to the flat portions 32 of the pressure pad 28 when the tube 30 is occluded.

Figure 6:
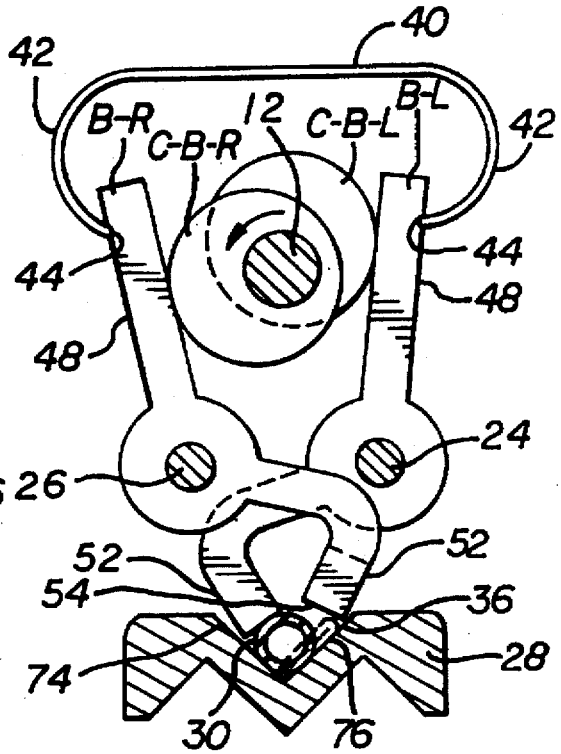
FIG. 6 is a cross-sectional view, taken at line 6—6, of the pump mechanism shown in FIG. 1, showing the pumping finger set B at the start of a pump cycle.

FIG. 6 shows pumping fingers B-L and B-R in their respective positions at the start of a mechanism cycle. Pumping finger B-R is fully retracted, while pumping finger B-L has partially advanced and restored the tube to its circular shape. As the pump cycle continues, pumping finger B-L will continue its advancement to compress the tube 30 against the left side wall 76 of V-shaped portion 36 of the pressure pad to a flattened (but not occluded) condition which is shown by dashed lines.

FIG. 7 shows pinching finger C in its retracted position, which has left the tube in a partially open condition between the flat portion 32 of the pressure pad 30 and the contact surface 72 of the lower portion 50 of pinching finger C. In this position, fluid that is pumped by pumping finger B-L flows downstream past this finger.

Figure 8:
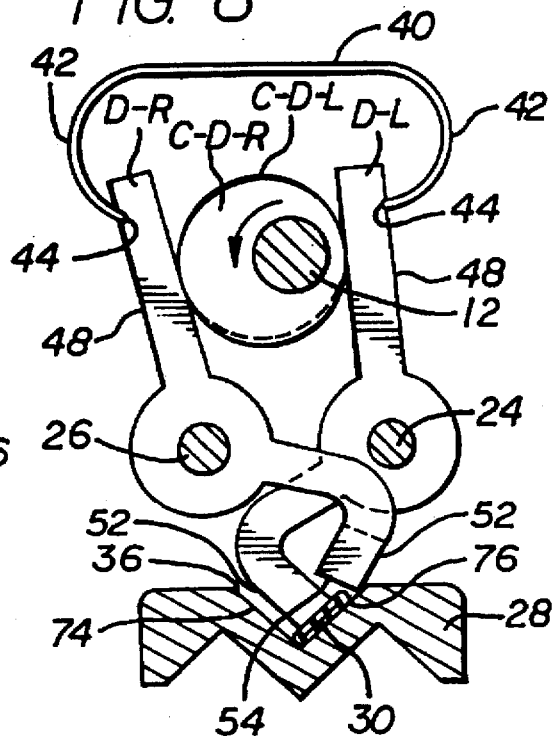
FIG. 8 is a cross-sectional view, taken at line 8—8, of the pump mechanism shown in FIG. 1, showing the pumping finger set D at the start of a pump cycle.

FIG. 8 shows pumping fingers D-L and D-R in their respective positions at the start of a mechanism cycle. At this point, pumping finger D-R is fully retracted so as not to interfere with pumping finger D-L which is fully advanced at the end of its pump stroke and has flattened (but not occluded) the tube 30 against the left side wall 76 of V-shaped portion 36 of the pressure pad 28 so as to expel fluid downstream.

Figure 11:
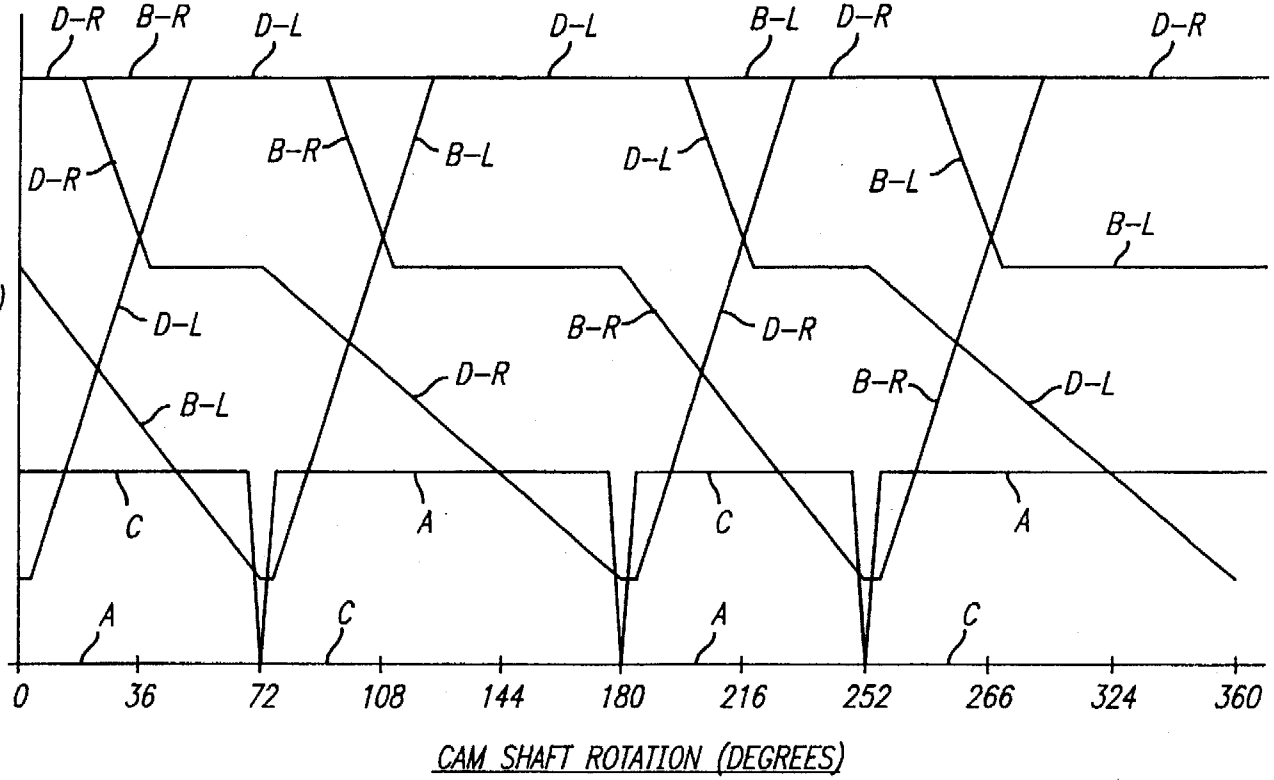
FIG. 11 is a graphical representation of the motions of the pinching and pumping fingers of the pump mechanism shown in FIG. 1.

The complete operational cycle of the pump mechanism of the invention is graphically illustrated by an X-Y plot in FIG. 11. The X axis represents the degrees of cam shaft rotation, and the Y axis represents the position of the pinching and pumping fingers with the effect of the fingers on the tube show in parentheses. The positions of pinching finger A, pumping fingers B-L and B-R, pinching finger C, and pumping fingers D-L and D-R are respectively represented by six lines designated as A, B-L, B-R, C, D-L, and D-R. The 0° position of the cam shaft is chosen as a reference point for the beginning of a cycle, and is the position of the cam shaft which causes the pinching and pumping fingers to assume the positions as shown in FIGS. 5–8.

As shown in FIG. 11, the cycle begins with pumping finger B-L starting at is intermediate position and going through its pump stroke (i.e. advancing to flatten the round tube). The positions of all the fingers at the beginning of the pump cycle are as shown in FIGS. 5–8. From 0° to 72° of cam shaft rotation, pinching finger A is fully advanced and occludes the portion of the tube under it. At approximately 72° of cam shaft rotation, pinching finger A retracts to allow the tube to open and pinching finger C occludes the tube. At about the same time, pumping finger B-L retracts from its advanced position and begins its fill stroke (i.e., retracting away from the tube until it reaches its fully retracted position) and pumping finger D-R advances from its intermediate position and begins its pump stroke. From 72° to 180° of cam shaft rotation, pinching finger C is fully advanced and continues to occlude the tube. At approximately 180°, pinching finger C retracts and pinching finger A advances and occludes the tube. At about the same time, pumping finger D-R begins its fill stroke (until it reaches full retraction) and pumping finger B-R advances from its intermediate position and begins its pump stroke. From 180° to 252°, pinching finger A is fully advanced and continues to occlude the tube. At approximately 252°, pinching finger A retracts and pinching finger C again occludes the tube. After 252°, pumping finger B-R begins its fill stroke and pumping finger D-L starts its pump stroke. From 252° to 360° (same as 0°), pinching finger C occludes the tube. Finally, at 360° (same as 0°) the fingers return back to their positions shown in FIGS. 5–8, and a full pump cycle is completed.

The above described cycle repeats itself with every full rotation of cam shaft. As stated, the timing and the movement of all the fingers is dependent on the design of the shape (profile) of the cams and the fingers, the particular orientation of each cam around the cam shaft, and the phase angles between the cams.

It should be noted that for purposes of simplicity, FIG. 11 shows the generic form of the motions of the fingers in the sense that all of the motions are shown as straight lines, meaning constant velocity motion. However, the design of the pump of the invention takes into account that the cams are actually designed so that these velocities would begin and end with a gradual change between zero and the desired velocity. In addition, the uniformity of flow is enhanced by modifying the pumping motion of the fingers to have a higher velocity at the start of their pump strokes and a lower velocity at the end of their pump strokes. Such enhancement in the flow would be a result of the need for maintaining the rate of change of the cross-sectional area of the tube as it is being compressed.

FIG. 11 also shows that the alternate opening and closing of the tube by pinching fingers A and C means that at any given time, the tube is fully occluded at one point along its length.

In order to load the tubing in the pump of the invention, after the door 84 is opened, a portion of the tube 30 is placed either against the pressure pad or through spacer notches 94 and across the contact surfaces of the lower portion 50 of the pinching fingers and the lower portion 52 of the pumping fingers, and then the door is closed. However there are special considerations to ensure the proper loading of the tube, specially in the V-shaped portions of the pressure pad 28. If the door were closed on the tubing with some pumping fingers 22 in the fully advanced position such as pumping finger D-L shown in FIG. 8, the tubing could be improperly lodged between those pumping fingers and the pressure pad. To prevent this situation, the pump of the invention includes a mechanism actuated by the opening of the door 84 which causes the pumping fingers that are at or near their advanced position to retract (e.g., from a position such as that of pumping finger D-L in FIG. 8 to a position such as that of pumping finger B-L in FIG. 6) so as to allow the tube to be aligned correctly between the V-shaped portions 36 of the pressure pad 28 and the pumping fingers 22.

Figure 12:
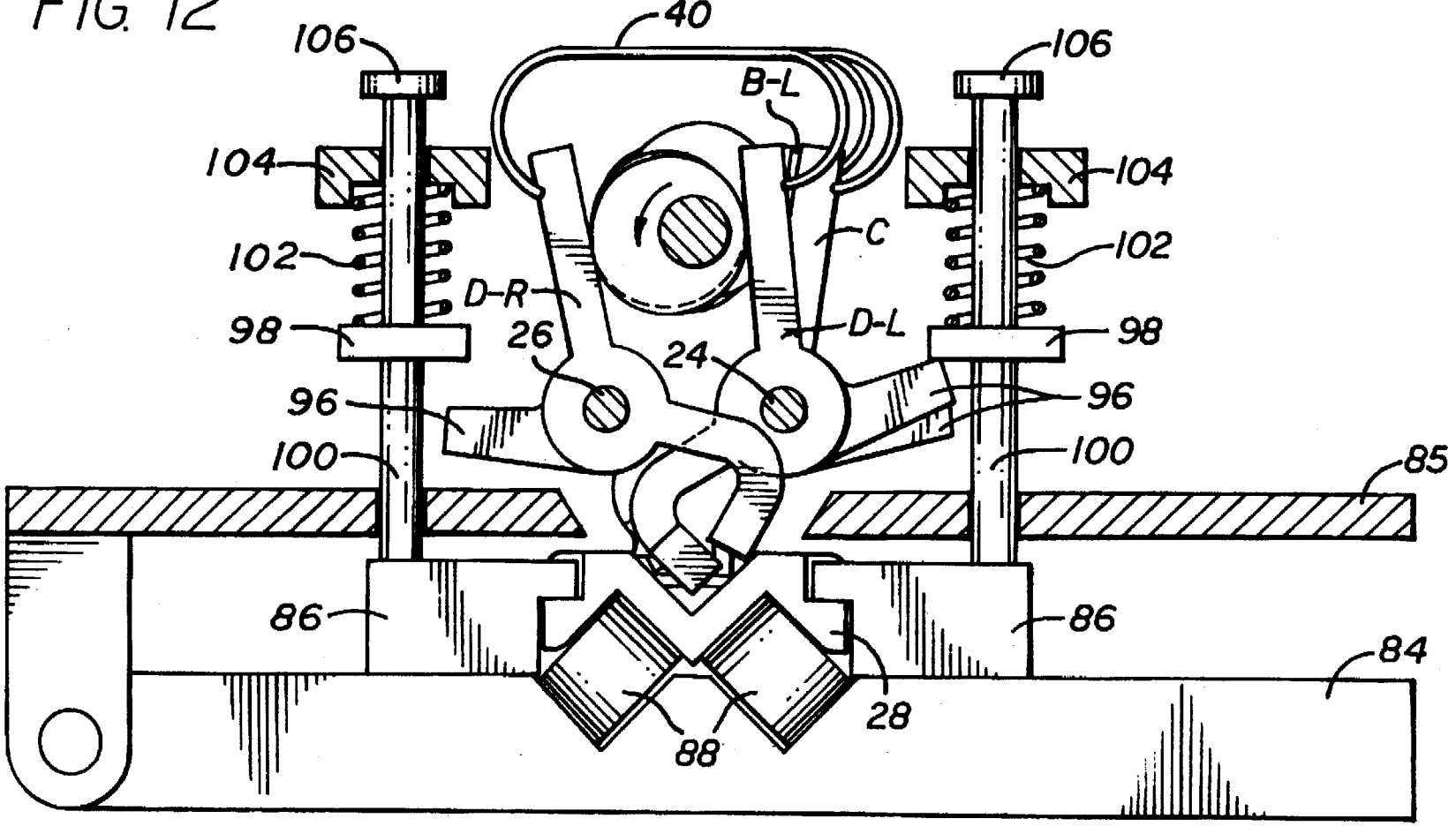
FIG. 12 is a cross-sectional view of the pump mechanism shown in FIG. 1 at pumping finger pair D, showing a finger retraction mechanism with the pump door closed.
Figure 13:
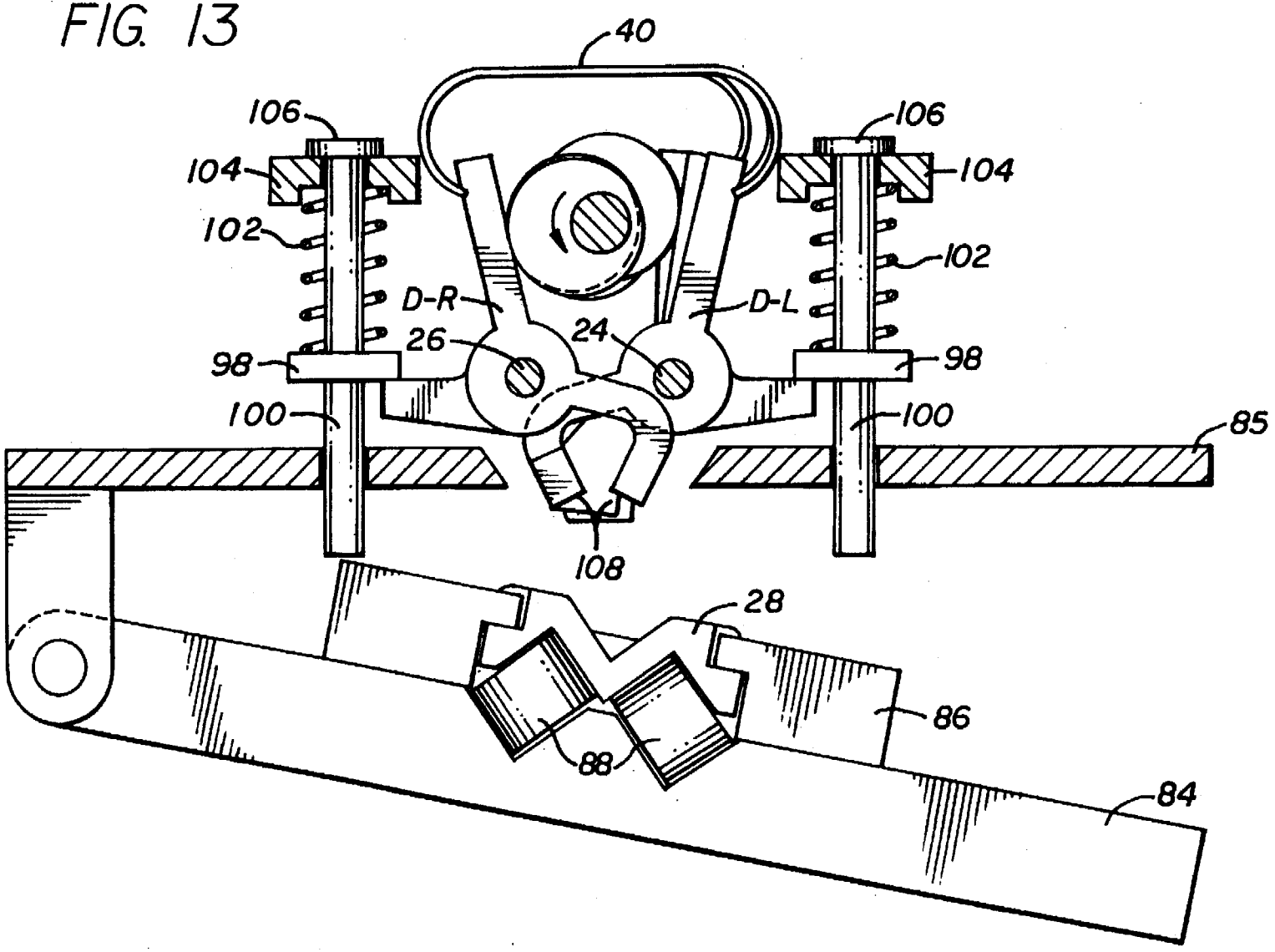
FIG. 13 is similar to FIG. 12, except that the pump door is opened.

One such mechanism is shown in FIGS. 12 and 13 (only pumping fingers D-L and D-R are shown for clarity). In this mechanism, the center round segment 60 of each pumping finger has a protrusion 96 which can be engaged by activator plates 98 located on the outside of each of the pivot shafts 24 and 26. The activator plate 98 is attached to an activator pin 100, and is urged toward the door 84 by an activator spring 102 (e.g., coil spring) which is placed between the activator plate 98 and a stationary spring seat 104. However, the movement of the activator pin 100, and therefore the activator plate 98, are limited by door-mounted pressure pad retainers 86 (see FIG. 12). When the door 84 is opened (see FIG. 13), the activator spring 102 moves the activator plate 98 downward toward the door until activator pin head 106 comes in contact with the spring seat 104. As the activator plate 98 moves downward, the contact between the activator plate 98 and the protrusion 96 of those pumping fingers which are in the advanced position causes those fingers to be retracted. With all of the pumping fingers retracted, a suitable V-groove 108 is formed to receive the tube which is to be loaded.

In the above finger retraction mechanism, there are preferably a total of four activator pins 100 and four activator springs 102 located on the outside of the left and right pivot shafts 24 and 26 next to the center round segments 60 of each of the upstream and downstream pumping finger sets. Also, the activator plate 98 is preferably a continuous plate running between each pair of the activator pins 100 (i.e., one activator plate for the right hand pumping fingers and one for the left hand pumping fingers). Furthermore, the activator springs must be strong enough to overcome the force of the arms 42 of the finger biasing spring 40 that are in contact with pumping fingers which are not yet fully retracted.

It should also be noted that a similar finger retraction mechanism could also be used to retract the pinching fingers 18. However, since the contact surface 72 of the lower portion 50 of each pinching finger 18 has a flat configuration and the closing of the door will move the pressure pad toward the contact surface in a relatively perpendicular direction, the tube will be positioned properly under the pinching fingers. Therefore, a retraction mechanism for the pinching fingers is not necessary for the embodiments that are shown here.

From the foregoing, it can be appreciated that the fluid delivery pump of the invention improves the useful life of the IV tube and increases the accuracy and consistency of the fluid flow rate through the tube. Although the tube used in IV sets typically possess resilient, deformable characteristics, their performance in IV pumps can be advantageously enhanced by the mechanism of the invention which aids in restoring the cross-sectional area of the tubing during the pumping operation. The restoration capability of the invention aids in preventing short or long-term deformation of the tube which can cause an unpredictable or inconsistent fluid flow rate over a period of time. Furthermore, the pump mechanism of the invention advantageously provides for a continuous and uniform controlled flow of the fluid to the patient, and prevents the occurrence of undesirable free flow from the fluid reservoir to the patient.

While particular forms of the invention have been illustrated and described, it will be apparent that various modifications can be made to the present invention without departing from the spirit and the scope thereof.

What is claimed is:

1. A method for delivering fluid through a resilient, deformable tube in a pump having a pressure pad for supporting said tube, a motor for generating a rotating motion to a cam shaft, a plurality of pinching fingers operatively engaged with said cam shaft, a plurality of pumping fingers operatively engaged with said cam shaft, said method comprising the steps of:

placing said tube between said pressure pad and said pinching and said pumping fingers;

occluding a first portion of said tube under the force of a first of said pinching fingers against said pressure pad;

applying force from a first direction on a second portion of said tube by a first of said pumping fingers against said pressure pad so as to pump fluid through said tube, said second portion being downstream of said first portion and substantially longer than said first portion;

occluding a third portion of said tube under the force of a second of said pinching fingers against said pressure pad, said third portion being located downstream of said second portion;

applying force from a first direction on a fourth portion of said tube by a second of said pumping fingers against said pressure pad so as to pump fluid through said tube, said fourth portion being downstream of said third portion and substantially longer than said third portion;

releasing said occluding force on said first portion of tube;

releasing said force from said first direction on said second portion;

applying force from a second direction by a third of said pumping fingers on said second portion of said tube to restore its cross-sectional area;

occluding said first portion of said tube under the force of said first of said pinching fingers against said pressure pad;

releasing said force from said first direction on said fourth section of tube;

applying force from a second direction by a fourth of said pumping fingers on said fourth position of said tube to restore its cross-section;

releasing said occluding force on said third portion of said tube;

applying force from said second direction on said second portion so as to pump fluid through said tube;

occluding said third portion of said tube under the force of said second pinching finger; and applying force from said second direction on said fourth portion so as to pump fluid through said tube.

2. The method of claim 1, wherein said pumping fingers each include a protrusion, configured such that depression thereof causes each finger to pivot away from said pressure pad and an activator element biased to depress said protrusion and configured to retract from said protrusion as the pressure pad is brought into proximity of said fingers, further comprising the steps of:

swinging said pressure pad away from said fingers prior to placing said tube between said pressure pad and said fingers so as to cause said activator element to depress said protrusions; and swinging said pressure pad toward said fingers after placing said tube between said pressure pad and said fingers so as to cause said activator element to retract from said protrusions.

3. A pump for delivering fluid through a resilient, deformable tube, comprising:

a pressure pad;

a plurality of pinching fingers for occluding sections of said tube against said pressure pad;

a first set of contact surfaces, actuated by pumping fingers for applying force in a first direction to extended sections of said tube, in a peristaltic sequence such extended sections being substantially longer than said sections occluded by said pinching finger, to occlude said tube against said pressure pad;

a second set of contact surfaces, actuated by pumping fingers, that apply force in a second direction to said extended sections previously occluded by first set of contact surfaces to occlude said tube against said pressure pad; and a motor operatively engaged with said pinching fingers and said pumping fingers to actuate said pinching fingers and said pumping finger so as to pump fluid through said tube.

4. The pump of claim 1, further comprising a plurality of pivot shafts, wherein said pinching fingers and said pumping fingers pivot about said pivot shafts for applying force on said tube.

5. The pump of claim 1, further comprising a spacer for spacing said pressure pad from said pinching fingers and said pumping fingers.

6. The pump of claim 5, wherein said pressure pad has a substantially V-shaped portion.

7. The pump of claim 1, wherein said motor is engaged with a cam shaft to rotate said cam shaft.

8. The pump of claim 7, wherein said pinching fingers are engaged with said cam shaft through a plurality of pinching cams and said pumping fingers are engaged with said cam shaft through a plurality of pumping cams.

9. The pump of claim 3, further comprising a retraction means for retracting said pumping fingers, so that said tube may be placed between said pressure pad and said pumping fingers.

10. The pump of claim 1, wherein said contact surfaces are actuated so as to collapse but not fully occlude said extended sections of said tube.

11. The pump of claim 1, wherein said first direction is different from said second direction.

12. The pump of claim 1, further comprising a mechanism for simultaneously retracting all contact surfaces of said first set of contact surfaces and all contact surfaces of said second set of contact surfaces from said tube so as to permit proper alignment of said tube upon repositioning of said pressure pad.

13. The pump of claim 12, further comprising:

a protrusion associated with each pumping finger, configured such that depression thereof causes said contact surface actuated thereby to pivot away from said tube; and an activator element biased to depress said protrusion and configured to retract from said protrusion as the pressure pad is brought into proximity of said contact surfaces.

14. A pump for delivering fluid through resilient, deformable tube, comprising:

support means for supporting said tube;

pinching means for alternatingly occluding sections of said tube against said support means and then releasing said tube;

pumping means for applying force to sections of said tube in a peristaltic sequence that are substantially longer than sections occluded by said pinching means and deforming said tube from alternatingly two different directions to pump fluid through said tube, and for urging said tube to restore said tube's cross-sectional area; and drive means for actuating said pinching means and said pumping means.

15. The pump of claim 14, wherein said drive means is engaged with said pinching means and said pumping means through a rotatable cam shaft having drive cams engaged with said pinching means and said pumping means.

16. The pump of claim 15, wherein said pinching means and said pumping means are biased to maintain contact with said drive cams.

17. The pump of claim 14, wherein said pumping means pivot about pivot means for applying force on said tube.

18. The pump of claim 14, wherein said support means is biased against said tube and said pinching means and said pumping means.

19. The pump of claim 14 further comprising a mechanism for simultaneously retracting all pumping means from said tube so as to permit proper alignment of said tube upon repositioning said support means.

20. A pump for delivering fluid through a resilient, deformable tube, comprising:

a pressure pad;

a plurality of pinching fingers for alternatingly occluding said tube against said pressure pad and then release said tube;

a plurality of pumping fingers that alternatingly apply force from different directions on said tube so as to deform said tube against said pressure pad in a peristaltic sequence to pump fluid through said tube and to urge said tube to restore said tube's cross-sectional area;

a motor operatively engaged with said pinching fingers and said pumping fingers to actuate said pinching fingers and said pumping fingers; and a plurality of pivot shafts, wherein said pinching fingers and said pumping fingers pivot about said pivot shafts for applying force on said tube.

21. The pump of claim 20, further comprising a mechanism for simultaneously retracting all pumping fingers from said tube so as to permit proper alignment of said tube upon repositioning of said pressure pad.

22. The pump of claim 21 further comprising:

a protrusion associated with each pumping finger, configured such that depression thereof causes said pumping finger to pivot away from said tube; and an activator element biased to depress said protrusion and configured to retract from said protrusion as the pressure pad is brought into proximity of said pumping finger.

23. A pump for delivering fluid through a resilient, deformable tube, comprising:

a pressure pad having a substantially V-shaped portion;

a plurality of pinching fingers for alternatingly occluding said tube against said pressure pad and then releasing said tube;

a plurality of pumping fingers that alternatingly apply force from different directions on said tube so as to deform said tube against said pressure pad in said V-shaped portion in a peristaltic sequence to pump fluid through said tube and to urge said tube to restore said tube's cross-sectional area; and a motor operatively engaged with said pinching fingers and said pumping fingers to actuate said pinching fingers and said pumping fingers.

24. The pump of claim 23, further comprising a mechanism for simultaneously retracting all pumping fingers from said tube so as to permit proper alignment of said tube upon repositioning of said pressure pad.

25. The pump of claim 24, further comprising:

a protrusion associated with each pumping finger, configured such that depression thereof causes said pumping finger to pivot away from said tube; and an activator element biased to depress said protrusion and configured to retract from said protrusion as the pressure pad is brought into proximity of said pumping finger.

* * * * *